United States Patent [19]

Kubota

[11] Patent Number: 4,848,688

[45] Date of Patent: Jul. 18, 1989

[54] METHOD FOR DETECTING A FOUND YARN END

[75] Inventor: Norio Kubota, Kyoto, Japan

[73] Assignee: Murata Kikai Kabushiki Kaisha, Kyoto, Japan

[21] Appl. No.: 151,838

[22] Filed: Feb. 3, 1988

[30] Foreign Application Priority Data

Feb. 9, 1987 [JP] Japan ..... 62-27871

[51] Int. Cl.[4] ..... B65H 54/00

[52] U.S. Cl. ..... 242/18 R; 242/35.5 R; 242/35.6 R; 242/35.6 E

[58] Field of Search ..... 242/36, 37 R, 18 R, 242/18 PW, 35.5 R, 35.5 A, 35.6 R, 35.6 E; 139/273 A

[56] References Cited

U.S. PATENT DOCUMENTS

| | | | |
|---|---|---|---|
| 2,026,146 | 12/1935 | Turner | 139/273 A |
| 3,029,031 | 4/1962 | Furst | 242/35.6 R |
| 3,053,137 | 9/1962 | Loepfe | 139/273 A |
| 3,544,018 | 12/1970 | Stoppard et al. | 242/35.6 R |

*Primary Examiner*—Stanley N. Gilreath

*Attorney, Agent, or Firm*—Spensley, Horn Jubas & Lubitz

[57] ABSTRACT

A found yarn end at a predetermined position of a spinning bobbin is detected after completion of a yarn end finding operation, whereby discrimination between success and failure in yarn end finding is made through detection of the presence or absence of the found yarn end after the actual yarn end finding treatment.

20 Claims, 4 Drawing Sheets

METHOD FOR DETECTING A FOUND YARN END

FIELD OF THE INVENTION

The present invention relates to a method for detecting a found yarn end of a spinning bobbin produced in a spinning frame.

RELATED ART STATEMENT

A spinning bobbin produced by a ring spinning frame (hereinafter referred to simply as the bobbin) is supplied to an automatic winder constituting the next step, where the yarn is rewound to form a package in suitable yarn amount and shape according to the intended use. The bobbin is provided with a bunch around a take-up tube portion at the top or bottom end of the bobbin, for preventing the yarn from being loosened during the feed of the bobbin. Therefore, prior to the supply of the bobbin to the winder, an operation of loosening the bunch to find and set the yarn end in a state convenient for starting winding at the winder is performed. Namely, a device generally called a yarn end finding device or a yarn end preparation device is provided in the vicinity of the winder. The bobbin fed from the spinning frame is once supplied to the yarn end finding device, where it is subjected to a yarn end finding treatment, before supplied to the winder.

As the yarn end finding device, there is known, for example, the device disclosed in Japanese Patent Application Laid-Open No. 61-45870 (1986). In this device, a yarn end led out of a bobbin by a suction mouth is cut at a predetermined position, the yarn end is inserted and let hung down into a central hole of the bobbin from the top end of the bobbin by a suction air flow into the central hole, and the bobbin in this state is supplied to the winder.

In the above-mentioned device, the success or failure in finding the yarn end is detected by a sensor disposed on a yarn path extending between the bobbin and the suction mouth. Namely, the sensor is disposed on the yarn path along which the yarn end led out extends between the bobbin and the suction mouth in the state of being guided into a cutter, to detect the yarn being located at a yarn detection position before cut by the cutter. The yarn end finding is regarded as successful or failed according as a yarn detection signal is or is not generated by the sensor. When the yarn end finding is regarded as successful, the bobbin discharged from the yarn end finding device is supplied to the winder. The bobbin for which the yarn end finding is regarded as failed is branchingly separated from a feed line.

As mentioned above, the discrimination between success and failure in the yarn end finding is performed by the detection of the yarn before being cut, on the assumption that the yarn detected to be present will be sucked into the central hole of the bobbin without fail after being cut. In practice, however, even if the presence of the yarn is detected by the sensor, it is not a hundred percent certain that the yarn end will be sucked into the central hole of the bobbin after being cut. Namely, the yarn end cut may not be sucked into the central hole, because of the contact thereof with other members, a deviation in the position of the bobbin, an insufficient suction force, etc. Even in such a case, the yarn end finding is regarded as successful in the above-mentioned device and, accordingly, a bobbin for which the yarn end finding is actually failed might be supplied to the winder.

OBJECT AND SUMMARY OF THE INVENTION

It is an object of the present invention to propose a method for securely detecting the presence or absence of a yarn end after completion of the yarn end finding treatment.

According to the present invention, a found yarn end present at a predetermined position of a bobbin is detected after completion of a yarn end finding operation, whereby discrimination between success and failure in yarn end finding is made through detection of the presence or absence of the found yarn end after the actual yarn end finding treatment.

DETAILED DESCRIPTION OF EMBODIMENTS

Figure 1:
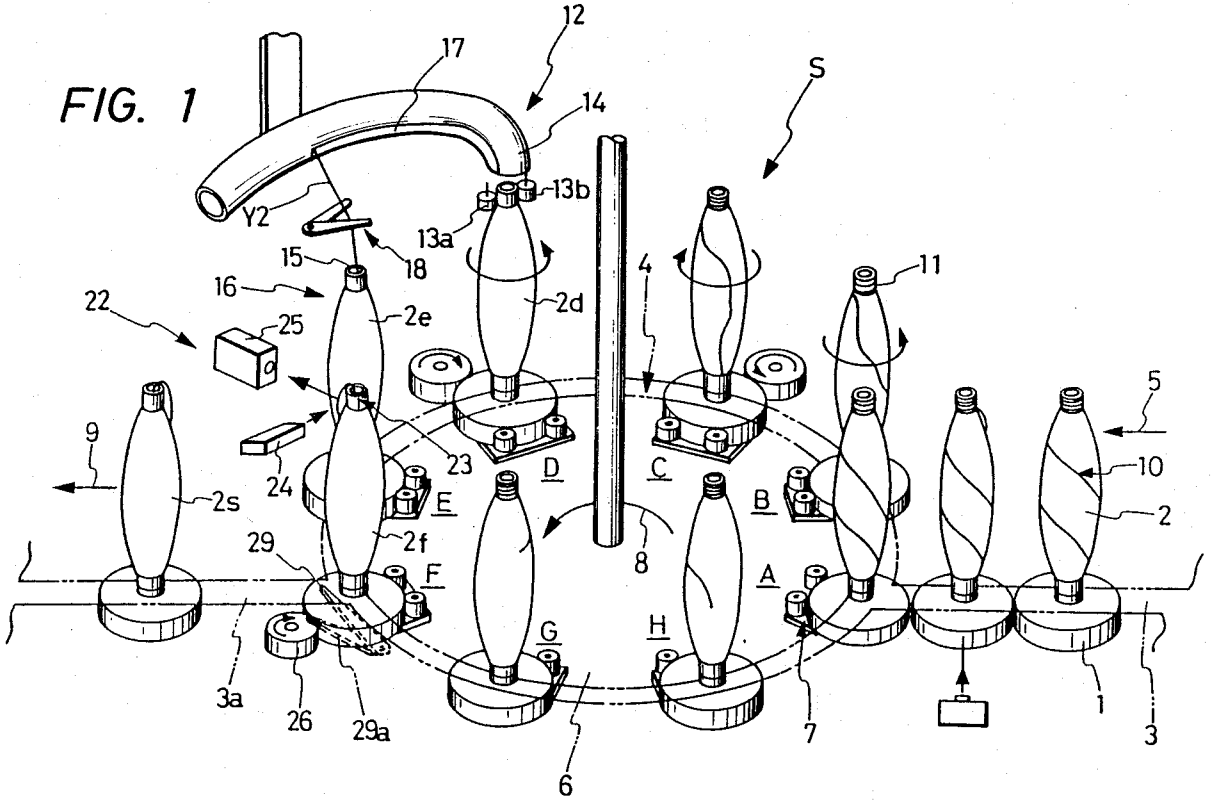
FIG. 1 is a schematic perspective view of the construction of a yarn end finding device, illustrating one example of the device for carrying out the present invention.

An embodiment of the present invention will now be explained below while referring to the drawings.

FIG. 1 illustrates an example of a yarn end finding device S for a top bunch.

At an intermediate position of a feed line 3, 3*a* of bobbins 2 fitted to trays 1 is provided a looped feed line 4. The looped feed line 4 is connected to the feeding-in line 3 at the position of a receiving station A and to the discharge line 3*a* at the position of a bobbin discharge station F. A portion of the looped feed line, from station A to station F is used as a passage for a yarn end finding treatment, and the remainder ranging from station F through stations G, H is used as a feed-back passage for the bobbins for which yarn end finding is failed.

The bobbin 2 from the spinning frame is fed along the feed line 3 in the direction of arrow 5 in the state of being fitted upright on the tray 1, to reach the receiving position A of the yarn end finding device. The bobbins 2 received by tray-receiving portions 7 provided at regular pitch on a rotary disk 6 of the yarn end finding device are passed through the treating stations B, C, D, E to the discharge station F, as the rotary disk 6 is intermittently rotated in the direction of arrow 8. The bobbin 2S for which yarn end finding is successful is fed along the feed line 3*a* in the direction of arrow 9 toward a winder.

A cutter device for loosening a bottom bunch is disposed at the station B only in the case of treating bobbins provided with a bottom bunch. In the present embodiment, the bobbins are provided with only a top bunch and, therefore, the cutter device is not provided, and the bobbin at the station B is made only to wait. At the station C is provided a searcher mechanism for searching for a yarn wound around the surface of a yarn layer of the bobbin 2, which is called a back wind 10. The back wind 10 is raised on the surface of the yarn layer.

Next, at station D, a loosening and suction device 12 for the top bunch 11 is disposed. For example, a pair of rollers 13*a*, 13*b* pressed against the portion of the top bunch 11 are disposed, with the axes of rotation thereof slightly inclined. Rotation of the rollers 13*a*, 13*b* loosens the top bunch 11, and the yarn freed from a top portion of the bobbin is sucked Y1 into a suction pipe 14 having an opening in the vicinity of the top portion of the bobbin.

Figure 3:
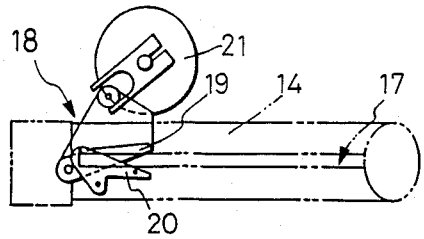
FIG. 3 is a plan view of the same.
Figure 2:
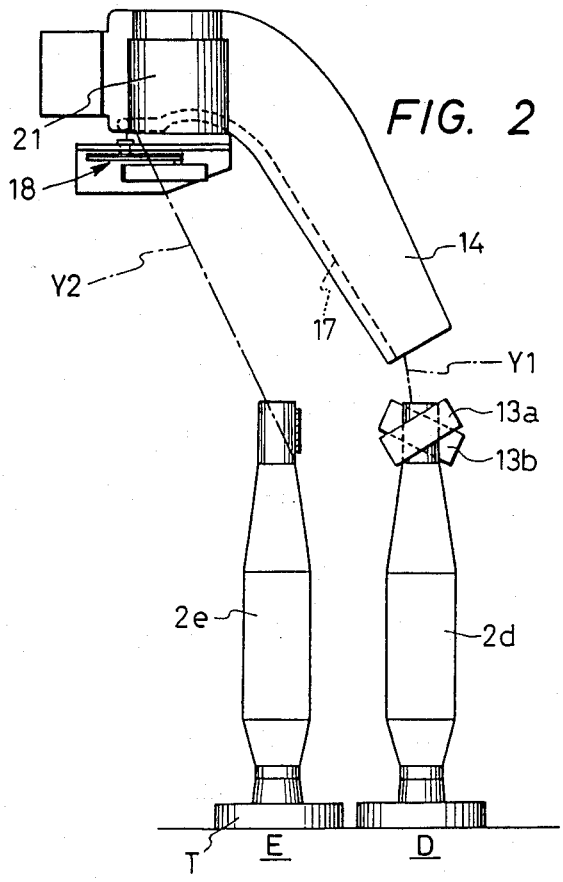
FIG. 2 is a front view of a yarn end cutting and inserting station.
Figure 4:
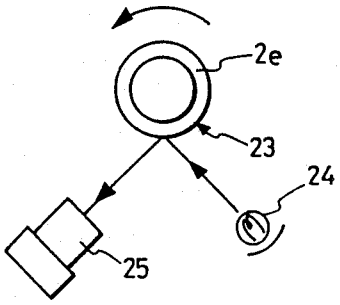
FIG. 4 is a plan view of station F.

Further, at station E, a yarn end inserting mechanism 16 is provided for cutting the yarn drawn out of the bobbin to a fixed length and inserting the yarn end into a central hole 15 of the bobbin 2. Namely, as shown in FIGS. 1 to 3, the yarn Y2 extending between the bobbin 2*e* positioned at the station E and a slit 17 of the suction pipe 14 takes a certain yarn path due to a tension arising from a suction force, and a cutter 18 into which the yarn is naturally guided when taking the yarn path is disposed above the bobbin. The cutter 18 comprises a movable blade 19 and a fixed blade 20 supported on shafts on opposite sides of the yarn Y2, and is operated in a timed manner by a drive source such as a rotary solenoid 21. In addition, at station E, a suction pipe (not shown) is disposed on the lower side of the tray 1 to generate a suction air flow in the central hole 15 of the bobbin 2*e* through an air flow passage hole formed through the tray. The yarn end Y2 on the bobbin side is inserted, by suction, into the central hole 15 from the upper end of the hole, under the suction air flow acting in the central hole concurrently with the operation of the cutter 18.

Moreover, at station F shown in FIG. 1, a yarn end detector 22 is provided for detecting the yarn end found and set at a predetermined position of the bobbin at the station E. The detector comprises, for instance, a projector 24 for projecting light on the peripheral surface 23 of the top portion of the bobbin, a light receiver 25 for receiving reflected light from the peripheral surface 23, and, preferably, a friction roller 26 for rotating the bobbin 2*f* about the axis of the bobbin.

Figure 5:
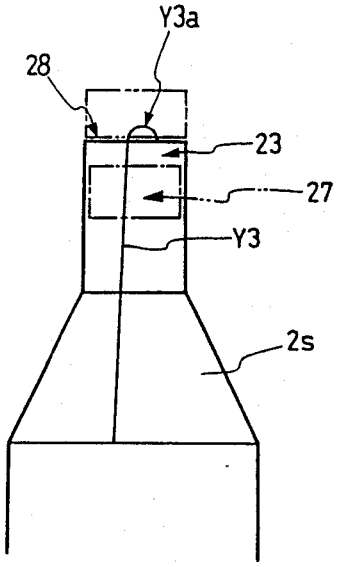
FIG. 5 is a typical illustration of light projection ranges.

As the light receiver 25, for instance, a color mark sensor can be applied: in the case of a bobbin such that the color of the peripheral surface thereof is not easy to discriminate from the color of the yarn end, it is difficult to discriminate the colors from each other by an ordinary optical sensor. In such a case, it is preferable to select a combination of the colors of the bobbin and the yarn such that the colors can be clearly discriminated from each other. For instance, where the yarn is white, it is preferable that the bobbin 23 is black or blue, ensuring a large difference in lightness between the colors. An image sensor such as a CCD can also be used as the light receiver. In addition, the yarn end Y3 inserted into the central hole of the bobbin is generally constituted of a single run of yarn Y3 drawn out of the surface of the yarn layer, as shown in FIG. 5, and accordingly, projection of light in only one direction may result in failure in detecting the yarn, depending on the position of the yarn. Accordingly, the rotation of the bobbin through the tray 1 by the friction roller 26 which is rotated positively makes it possible to perform detection of the presence or absence of the yarn over the entire peripheral surface of the bobbin.

The light projection range is suitably the range 27 bounded by an alternate long and short dash line on the peripheral surface of the bobbin, lighted in the direction perpendicular to the paper surface, as shown in FIG. 5.

In some cases, the projection range may be the range bounded by an alternate long and two short dashes line, on the upper side of the top end face 28 of the bobbin, whereby a portion of the yarn Y3 drawn out of the yarn layer is bent at the top end portion of the bobbin to be inserted into the central hole, so to call it, a bent portion Y3*a* can be detected.

A movable guide 29 is disposed at a branch point of the tray feed line at the station F. The movable guide 29 is normally set in the solid-line position. When detection of the found yarn end of the bobbin arriving at the station F is finished and the yarn end finding is successful, the movable guide 29 is moved to the position 29*a* indicated by the alternate long and two short dashes line by the driving of a rotary solenoid or the like (not shown), whereby the bobbin 2*f* at the station F is discharged onto the feed line 3*a* simultaneously with a turning of a conveyor. On the other hand, when the yarn end is not detected in the found yarn end detecting step at the station F and the yarn end finding is discriminated to be failed, the movable guide 29 is set into an inoperative state and the bobbin at that position is fed to a bypass station G as the next yarn end finding cycle is started, under control.

Figure 6:
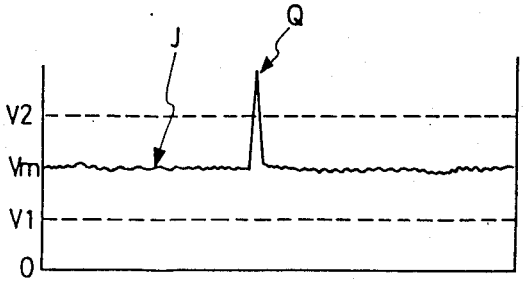
FIG. 6 is a reflected light quantity level diagram obtained by projecting light on a bobbin for which the yarn end finding is successful.

FIG. 6 shows a waveform chart of a signal obtained by the detector 22 in the case of a successful yarn end finding, in which a conspicuous difference appears between the level J of the quantity of light reflected by the peripheral surface of the bobbin and the level Q of the quantity of light reflected at the part where the yarn Y3 is present. It is possible to treat the signal so that the level Q protrudes downwards below the level J concerning the peripheral surface of the bobbin. Therefore, when set levels V1, V2 are provided respectively on both sides of the level Vm of the quantity of light reflected by the peripheral surface of the bobbin, the yarn end finding is discriminated to be successful when there appears a level protruding out of the range set by the levels V1, V2.

Figure 7:
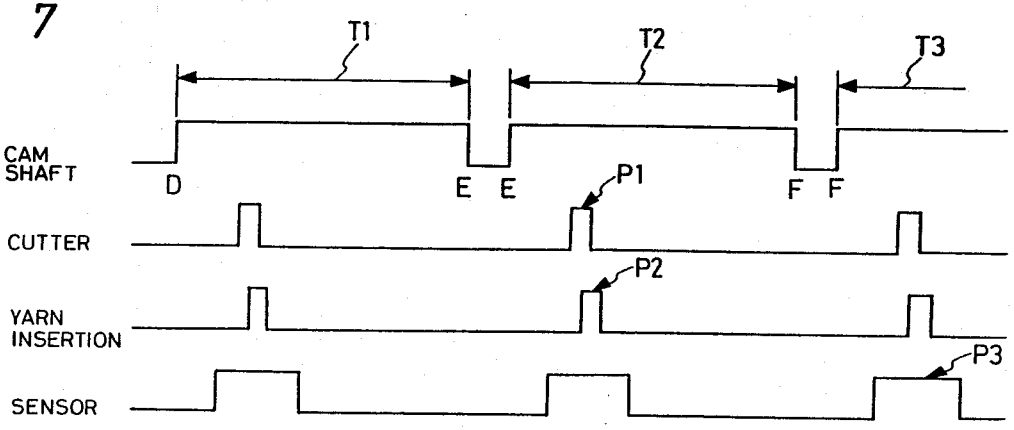
FIG. 7 is an operation timing chart of the yarn end finding device.

In FIG. 7, which shows a timing chart of the yarn end finding device S shown in FIG. 1, one cycle T1 of a cam shaft is, for instance, the cycle in which the bobbin 2*e* located at the station E in the state shown in FIG. 1 is subjected to a yarn end cutting and inserting treatment and fed to the next station F. The cam shaft is stopped once in each cycle. Namely, feeding of the bobbins to stations A–F is performed by intermittent feeding in each cycle. By the driving of the cam shaft, various drive sources for the yarn end finding treatment are operated in a timed manner, under control.

Namely, when the cycle T1 is started, the bobbin 2*d* at the station D has its top bunch loosened by the rollers 13*a*, 13*b* or the like, has a yarn end sucked by the suction pipe 14, and the bobbin 2*d* in this state is fed to the station F, whereby the one cycle T1 is completed. Therefore, the bobbin 2*e* reaching the station E is stopped under the condition where the yarn Y2 extends between the bobbin 2*e* and the suction pipe 14. Naturally, the yarn Y2 is already introduced to an operating position of the cutter 18. When the next cycle T2 is started, the found yarn end cut is inserted P2 into the central hole 15 of the bobbin 2*e* at the station E by the operation P1 of the cutter 18, the bobbin 2*e* is fed from the station E to the station F near the end of the one cycle T2, and is positioned and stopped at the station F, whereby the one cycle T2 is completed.

Subsequently, with the next one cycle T3 started, detection P3 of the found yarn end is carried out at the station F. Namely, the bobbin 2*f* is rotated by the friction roller 26, while the detector 22 detects the level of the quantity of light reflected by the surface of the bobbin. When there is a level Q greater than the set point V2 as shown in FIG. 6, the yarn end finding is regarded successful. In this case, a signal for driving the movable guide 29 is outputted, whereby the guide 29 is moved to the alternate long and two short dashes line 29*a* in FIG. 1, and the bobbin 2S for which the yarn end finding is successful and which is located at the station F is discharged to the feed line 3*a*. On the other hand, for the bobbin for which the yarn end finding is failed, the level Q in FIG. 6 does not appear. Accordingly, the signal for driving the guide is not outputted, the movable guide 29 remains stopped at the solid-line position, and near the end of the one cycle T3, the bobbin is fed from the station F to the station G, to be fed to the station A for subjecting the bobbin again to the yarn end finding operation.

Figure 8:
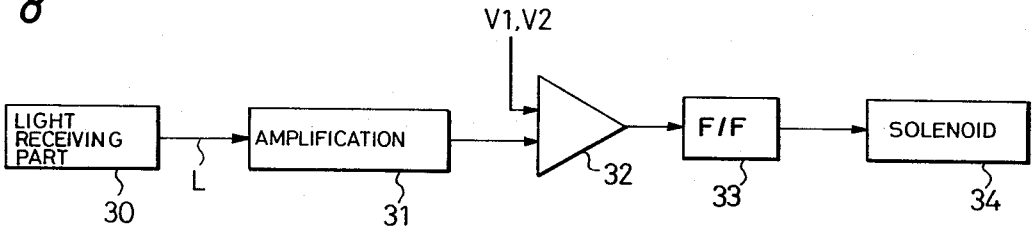
FIG. 8 is a block diagram showing one example of a controller for the detection of a yarn end.

FIG. 8 shows an example of a controller for the movable guide 29. A light quantity level signal L obtained at a light-receiving part 30 is amplified by an amplifier 31 to be a signal suitable for processing, the amplified signal is introduced to a comparator 32 to be compared with the set levels V1, V2, and when the signal appears exceeding the set level, a solenoid 34 for driving the movable guide 29 is excited through a flip-flop circuit 33.

In the case of the normal, successful yarn end finding operation (whereby a single run of the yarn is inserted into a central hole of the bobbin), the level signal obtained by the detector 22 has a single peak level Q, as shown in FIG. 6, but where a few or a plurality of runs of the yarn are inserted into the central hole of the bobbin due to some cause, there is a possibility that a plurality of peak levels Q appear in the reflected light quantity level diagram. In such a case, it is possible to regard the yarn end finding for the bobbin as improper and subject the bobbin again to the yarn end finding treatment without discharging the bobbin from the yarn end finding device, or to once discharge the bobbin from the yarn end finding device as a troubled bobbin and separately adjust the bobbin manually.

Though a noncontact-type optical sensor is employed as the sensor for detecting the found yarn end in the working example explained above, a contact-type feeler may also be used to directly detect the yarn end. Further, though the position for detecting the found yarn end is provided at the bobbin discharging position F of the yarn end finding device in the working example above, it is natural that the detecting position can be provided at the station E for inserting the yarn end, or can be provided at an intermediate position of the feed line 3*a* so as to feed back the bobbin associated with failed yarn end finding to the yarn end finding device through an another bypass.

As described above, according to the present invention, whether the yarn end is found and set at a predetermined position by a yarn end finding device is discriminated by inspecting the bobbin after completion of the yarn end finding treatment, whereby it is possible to securely detect the presence or absence of the yarn end and to supply the winder with only the bobbins for which the yarn end finding is successful.

What is claimed is:

1. A method for detecting a yarn end of yarn wound about a spinning bobbin, said spinning bobbin having a peripheral surface and a take-up tube provided with a central hole therein, said method comprising the steps of:

inserting the yarn end into the central hole of the take-up tube whereby the yarn extends adjacent a position of the peripheral surface of the spinning bobbin; and detecting whether the yarn is present adjacent said position of the peripheral surface after the yarn end is inserted into the central hole;

wherein said step of detecting whether the found yarn end is present includes the step of rotating the spinning bobbin.

2. The method as claimed in claim 1, wherein said step of inserting includes steps of cutting a yarn drawn out of the spinning bobbin to a fixed length and inserting the cut yarn end extending from the spinning bobbin into the central hole of the take-up tube of the spinning bobbin.

3. The method as claimed in claim 1, wherein said position of the peripheral surface of the spinning bobbin is located on a top end portion of the take-up tube of the spinning bobbin.

4. The method as claimed in claim 2, wherein the yarn drawn out of the yarn layer of the spinning bobbin is bent at a portion of the yarn upon inserting the yarn end into the central hole and wherein said position of the peripheral surface of the spinning bobbin is a portion on an upper side of a top end face of a spinning bobbin adjacent the portion of the yarn where the yarn drawn out of the yarn layer of the spinning bobbin is bent to bent to be inserted into the central hole of the bobbin.

5. The method as claimed in claim 2, further comprising the steps of discriminating whether the yarn end finding operation is successful in response to the detection of a found yarn end and controlling the discharge of the spinning bobbin onto a feed line in response to said step of discriminating.

6. The method as claimed in claim 5, wherein said step of detecting whether a found yarn end is present includes the steps of reflecting light from said position of the peripheral surface of the spinning bobbin and detecting the level of the quantity of light reflected by the surface of the bobbin at said position, and wherein the step of discriminating whether the yarn end finding operation is successful includes the step of determining whether said level of the quantity of reflected light is greater than a set point, and providing a signal for driving a movable guide for discharging a bobbin to the feed line.

7. The method as claimed in claim 6, further comprising the steps of determining whether the yarn end finding operation is improper and causing the bobbin to be subjected again to the yarn end finding operation when the level of the quantity of reflected light includes a plurality of peak levels.

8. A device for detecting whether a yarn end found by a yarn end finder in a yarn end finding operation is extending in a single run adjacent a predetermined position of the peripheral surface of a spinning bobbin after completion of the yarn end finding operation, said device for detecting comprising a projector for projecting light on the predetermined position of the peripheral surface of the spinning bobbin and toward the single run of the yarn end, a light receiver for receiving reflected light from the peripheral surface, and a friction roller for rotating the spinning bobbin about an axis of the bobbin.

9. The device as claimed in claim 8, wherein said light receiver is a color mark sensor.

10. A device for detecting the yarn end of a single run of yarn drawn out from as pinning bobbin and arranged adjacent the peripheral surface of the spinning bobbin in a yarn end finding operation, said device comprising:

emitting means for emitting radiation toward the peripheral surface of the spinning bobbin, following the yarn end finding operation, to cause radiation to be reflected from at least one of the peripheral surface and the single run of yarn; and receiving means operable for receiving said reflected radiation.

11. A device as claimed in claim 10, further comprising rotating means for rotating the spinning bobbin during the receiving operation of said receiving means.

12. A device as claimed in claim 10, wherein:

said emitting means comprises a light projector arranged for projecting light in a first light path to cause reflected light in a second light path wherein at least one of said first and second light paths traverses the single run of yarn, whereby a portion of at least one of said projected and reflected light is modified by the single run of yarn; and said receiving means comprises a light receiver for receiving said reflected light.

13. A device as claimed in claim 12, further comprising:

signal providing means, operatively connected with said light receiver, for providing a signal having a signal value dependent upon the reflected light received by said light receiver; and a discriminating means, having a preset threshold value, for determining whether said signal value traverses said preset threshold value, said discriminating means being operatively connected with said signal providing means.

14. A device as claimed in claim 13, wherein said preset threshold value is set to a value which said signal value traverses upon modification of at least one of said projected and reflected light by the single run of yarn.

15. A device as claimed in claim 10, wherein:

said emitting means is arranged to emit radiation in a first path of radiation and cause reflected radiation in a second path of radiation;

at least one of said first and and second paths of radiation traverses the single run of yarn; and the single run of yarn modifies at least one of the emitted and reflected radiation.

16. A device as claimed in claim 15, further comprising detecting means, operatively connected with said receiving means, for detecting the modification of the received radiation caused by the single run of yarn.

17. A device as claimed in claim 16, further comprising rotating means for rotating the spinning bobbin during the detecting operation of said detecting means.

18. A method of detecting the yarn end of a single run of yarn drawn out from a spinning bobbin and arranged adjacent the peripheral surface f the spinning bobbin in a yarn end finding operation, said method comprising the steps of:

emitting radiation in a first path toward the peripheral surface of the spinning bobbin, following the yarn end finding operation, to cause radiation to be reflected in a second path from at least one of the spinning bobbins and the single run of yarn;

receiving the reflected radiation; and comparing the received radiation with a preset value.

19. A method as claimed in claim 18, wherein:

said step of emitting comprises projecting light toward the spinning bobbin and reflecting light from at least one of the spinning bobbins and the single run of yarn, wherein the single run of yarn traverses and modifies at least one of the projected light and the reflected light; and said steps of comparing comprises detecting received light which is modified by a single run of yarn.

20. A method as claimed in claim 19, further comprising the step of rotating the spinning bobbin during said step of receiving.

* * * * *